US010815950B2

(12) United States Patent
Ahn

(10) Patent No.: US 10,815,950 B2
(45) Date of Patent: Oct. 27, 2020

(54) CONSTRUCTION MACHINE STARTING ASSIST SYSTEM

(71) Applicant: Doosan Infracore Co., Ltd., Incheon (KR)

(72) Inventor: Hyeon Sik Ahn, Seoul (KR)

(73) Assignee: DOOSAN INFRACORE CO., LTD., Dong-Gu, Incheon (KR)

( * ) Notice: Subject to any disclaimer, the term of this patent is extended or adjusted under 35 U.S.C. 154(b) by 247 days.

(21) Appl. No.: 15/553,851

(22) PCT Filed: Feb. 27, 2015

(86) PCT No.: PCT/KR2015/001951
§ 371 (c)(1),
(2) Date: Aug. 25, 2017

(87) PCT Pub. No.: WO2016/137041
PCT Pub. Date: Sep. 1, 2016

(65) Prior Publication Data
US 2018/0038333 A1 Feb. 8, 2018

(51) Int. Cl.
*F02N 7/00* (2006.01)
*E02F 9/22* (2006.01)
(Continued)

(52) U.S. Cl.
CPC ..... *F02N 7/00* (2013.01); *E02F 9/2066* (2013.01); *E02F 9/2217* (2013.01);
(Continued)

(58) Field of Classification Search
CPC ..... F02N 7/00; E02F 9/2217; F15B 21/14; F15B 2211/851; F15B 2211/853; F15B 2211/633; Y02T 10/48
See application file for complete search history.

(56) References Cited

U.S. PATENT DOCUMENTS 3,945,207 A 3/1976 Hyatt
9,309,899 B2 * 4/2016 Kim ..... E02F 9/2217
(Continued)

FOREIGN PATENT DOCUMENTS

CN 104358729 A 2/2015
EP 2949951 12/2015
(Continued)

OTHER PUBLICATIONS

International Search Report (with English translation) issued in international application No. PCT/KR2015/001951, dated Nov. 17, 2015, 5 pages.
(Continued)

*Primary Examiner* — Dustin T Nguyen
(74) *Attorney, Agent, or Firm* — K&L Gates LLP

(57) ABSTRACT

An exemplary embodiment of the present disclosure relates to a construction machine starting assist system including: an engine of a construction machine; an input unit which receives a key-on signal and a key-off signal of the engine; a hydraulic pump which is operated by the engine; an actuator which is operated by hydraulic oil discharged from the hydraulic pump; a regeneration valve which is switched so that a part or an entirety of the hydraulic oil returned from the actuator; an accumulator which is charged with the hydraulic oil supplied from the regeneration valve; a charging valve which is controlled so that the hydraulic oil is discharged from the accumulator when the key-on signal is inputted into the input unit; and a hydraulic motor connected to the engine and configured to assist in starting the engine.

8 Claims, 6 Drawing Sheets

(51) Int. Cl.

| | |
|---|---|
| ***F15B 21/14*** | (2006.01) |
| ***F02D 29/04*** | (2006.01) |
| ***F02N 9/00*** | (2006.01) |
| ***E02F 9/20*** | (2006.01) |
| ***F15B 1/02*** | (2006.01) |
| ***F15B 1/033*** | (2006.01) |
| *F15B 11/08* | (2006.01) |

(52) U.S. Cl.

CPC ..... *E02F 9/2225* (2013.01); *E02F 9/2228* (2013.01); *E02F 9/2235* (2013.01); *E02F 9/2292* (2013.01); *E02F 9/2296* (2013.01); *F02D 29/04* (2013.01); *F02N 9/00* (2013.01); *F15B 1/024* (2013.01); *F15B 1/033* (2013.01); *F15B 11/08* (2013.01); *F15B 21/14* (2013.01); *F15B 2201/51* (2013.01); *F15B 2211/705* (2013.01)

(56) References Cited

U.S. PATENT DOCUMENTS

| | | | | |
|---|---|---|---|---|
| 9,482,246 | B2 * | 11/2016 | Geissler | B60K 11/00 |
| 9,745,940 | B2 * | 8/2017 | Morris | E02F 9/2066 |
| 2002/0166530 | A1 * | 11/2002 | Tachikawa | F02N 5/00 123/179.3 |
| 2009/0266067 | A1 * | 10/2009 | Persson | F15B 1/024 60/327 |
| 2013/0111890 | A1 * | 5/2013 | Rosth | B66F 9/22 60/327 |
| 2015/0052889 | A1 * | 2/2015 | Krittian | F02N 7/00 60/596 |
| 2017/0218984 | A1 * | 8/2017 | Ogawa | F16F 9/34 |

FOREIGN PATENT DOCUMENTS

| | | | | |
|---|---|---|---|---|
| JP | 2011220390 | A | 11/2011 | |
| JP | 2013091953 | A | 5/2013 | |
| JP | 2014227949 | * | 12/2014 | F02N 7/00 |
| JP | 2014227949 | A | 12/2014 | |
| JP | 4948643 | | 7/2017 | |
| KR | 10-2011-0012037 | | 2/2011 | |
| KR | 20110073887 | A | 6/2011 | |
| KR | 10-2014-0083119 | | 7/2014 | |
| KR | 10-2014-0123636 | | 10/2014 | |
| WO | 2011074672 | | 6/2011 | |
| WO | WO2014115645 | | 7/2014 | |
| WO | WO2016040484 | | 3/2016 | |

OTHER PUBLICATIONS

Written Opinion issued in international application No. PCT/KR2015/001951, dated Nov. 17, 2015, 5 pages.

Extended European Search Report issued in related European Patent Application No. 15883430.9 dated Sep. 26, 2018.

Korean Office Action for related Korean Application No. 10-2014-0021123; action dated Oct. 17, 2019; (4 pages).

Chinese Office Action for related Chinese Office Action 201580077074.8; action dated Dec. 5, 2019; (10 pages).

* cited by examiner

CONSTRUCTION MACHINE STARTING ASSIST SYSTEM

CROSS REFERENCE TO RELATED APPLICATIONS

The present application is a National Stage of International Application No. PCT/KR2015/001951, filed on Feb. 27, 2015, the entire content of which is incorporated herein by reference.

TECHNICAL FIELD

An exemplary embodiment of the present disclosure relates to a construction machine, and more particularly, to a construction machine starting assist system.

BACKGROUND ART

In general, a construction machine such as an excavator or a wheel loader uses an engine as a power source and performs an operation of operating, driving, or swing working apparatuses such as a boom, an arm, and a bucket.

Working and traveling operations of the construction machine are performed after turning on the engine. When the construction machine receives a starting signal from outside pressure, a battery of the construction machine is activated and supplies electric power. In this case, the battery is mounted in the construction machine, and not only supplies electric power required to start the engine, but also supplies electric power to all electric devices that require electric power.

The construction machine in the related art uses the battery and a starter motor in order to start the engine.

Meanwhile, recently, a hydraulic motor and a hydraulic pump are additionally mounted in order to improve working and traveling efficiency of the construction machine. The construction machine is mounted with and uses the battery with high capacity because a large load is applied when starting the engine.

However, in a case in which an outside temperature is low like during the winter season, lubrication properties and efficiency of the battery deteriorate because of the outside temperature even though the battery has a high capacity, and as a result, there is a problem in that the engine does not start well.

Furthermore, in a case in which the capacity of the mounted battery is unlimitedly increased in order to improve startability of the construction machine, there is a problem in that manufacturing costs of the construction machine is increased.

DISCLOSURE

Technical Problem

An exemplary embodiment of the present disclosure provides a construction machine starting assist system and a control method which are capable of improving cold startability of a construction machine when an outside temperature is low like during the winter season.

Technical Solution

An exemplary embodiment of the present disclosure provides a construction machine starting assist system including: an engine of a construction machine; an input unit which receives a key-on signal and a key-off signal of the engine; a hydraulic pump which is operated by the engine; an actuator which is operated by hydraulic oil discharged from the hydraulic pump; a regeneration valve which is switched so that a part or an entirety of the hydraulic oil returned from the actuator and a part or an entirety of the hydraulic oil discharged from the hydraulic pump are supplied for regeneration; an accumulator which is charged with the hydraulic oil supplied from the regeneration valve; a charging valve which is controlled so that the hydraulic oil is discharged from the accumulator when the key-on signal is inputted into the input unit; and a hydraulic motor which is operated by the hydraulic oil discharged from the charging valve, in which the hydraulic motor is connected to the engine and assists in starting the engine.

The construction machine starting assist system may further include: a solenoid valve which receives the hydraulic oil from the accumulator and adjusts a swash plate angle of the hydraulic motor; and a controller which controls the regeneration valve and the solenoid valve.

The controller may detect a hydraulic pressure of the hydraulic oil with which the accumulator is charged when the input unit receives the starting key-off signal, and when the hydraulic pressure of the accumulator is below a predetermined value, the controller may operate the engine to charge the accumulator with the hydraulic oil discharged from the hydraulic pump until the hydraulic pressure of the hydraulic oil with which the accumulator is charged reaches the predetermined value, and then the controller may turn off the engine.

When the engine is turned off, the controller may close the solenoid valve so that the supply of the hydraulic oil supplied from the accumulator to the hydraulic motor is cut off.

Advantageous Effects

According to the exemplary embodiment of the present disclosure, the construction machine starting assist system stores hydraulic oil in the accumulator while the engine is operated, and uses the hydraulic oil to produce starting torque when starting the engine, and as a result, it is possible to effectively improve startability of the construction machine and reduce manufacturing costs of the construction machine because it is not necessary to greatly increase a capacity of the battery for starting the engine. In addition, the engine of the construction machine may be independently started, even without a starter motor, when the engine is required to be started such as when a starter motor is broken down or the battery is discharged.

DESCRIPTION OF MAIN REFERENCE NUMERALS OF DRAWINGS

Figure 1:
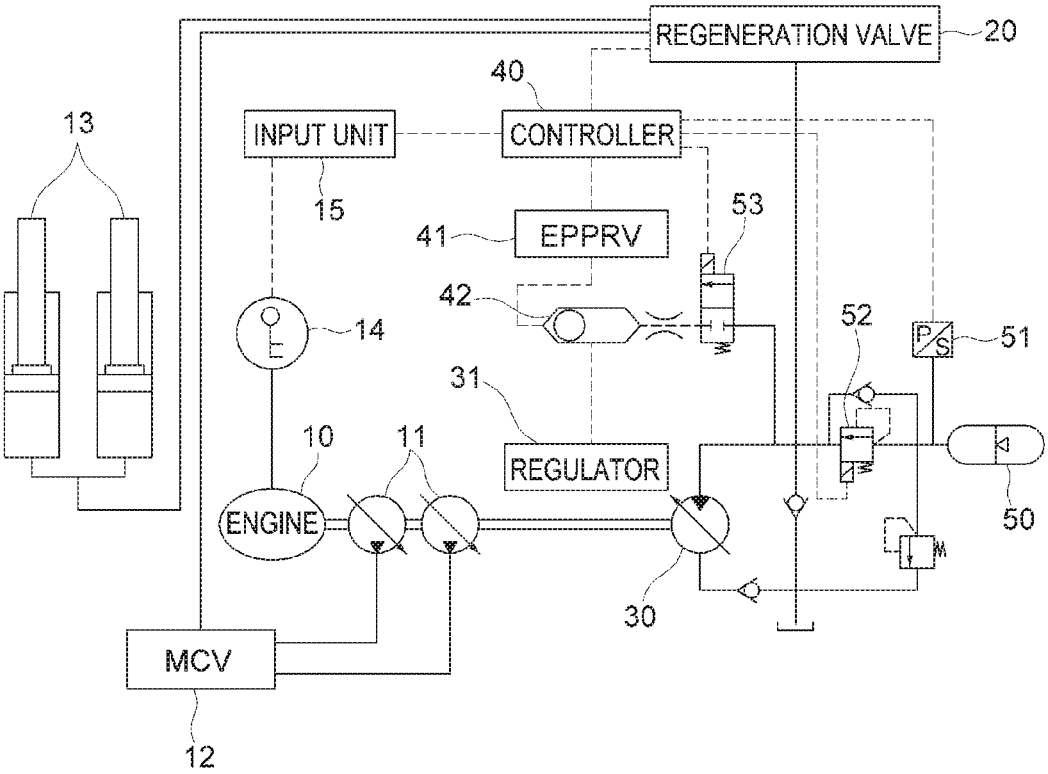
FIG. 1 is a circuit diagram illustrating a construction machine starting assist system according to an exemplary embodiment of the present disclosure.

10: Engine
11: Hydraulic pump

12: Main control valve (MCV)
13: Actuator
14: Key switch
15: Input unit
20: Regeneration valve
30: Hydraulic motor
40: Controller
41: Electromagnetic proportional pressure reducing valve (EPPRV)
42: Shuttle valve
50: Accumulator
51: Pressure sensor
52: Relief valve
53: Solenoid valve

BEST MODE

Hereinafter, exemplary embodiments of the present disclosure will be described in detail with reference to the accompanying drawings so that those skilled in the technical field to which the present disclosure pertains may easily carry out the exemplary embodiments. The present disclosure may be implemented in various different ways, and is not limited to the exemplary embodiments described herein.

It is noted that the drawings are schematic, and are not illustrated based on actual scales. Relative dimensions and proportions of parts illustrated in the drawings are exaggerated or reduced in size for the purpose of clarity and convenience in the drawings, and any dimension is just illustrative but not restrictive. Further, the same reference numerals designate the same structures, elements or components illustrated in two or more drawings in order to exhibit similar characteristics.

Exemplary embodiments of the present disclosure illustrate ideal exemplary embodiments of the present disclosure in detail. As a result, various modifications of the drawings are expected. Therefore, the exemplary embodiments are not limited to specific forms in regions illustrated in the drawings, and for example, include modifications of forms by the manufacture.

Hereinafter, a construction machine starting assist system according to an exemplary embodiment of the present disclosure will be described with reference to FIGS. 1 to 3.

Figure 2:
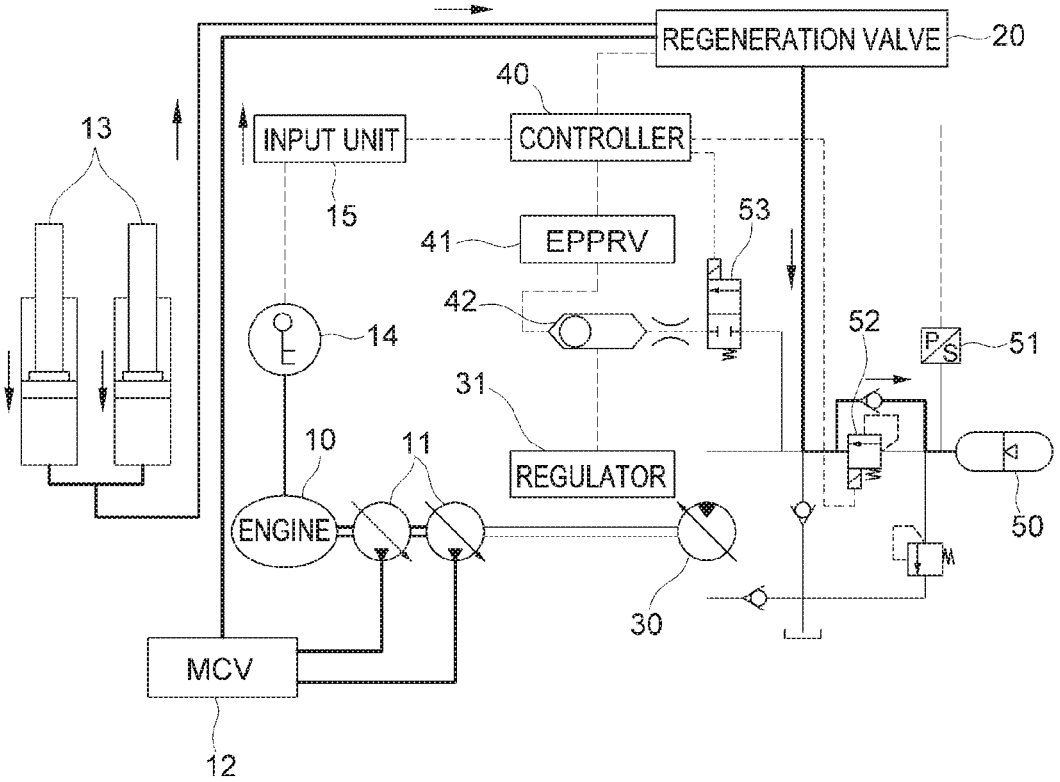
FIGS. 2 and 3 are circuit diagrams illustrating operating states of the construction machine starting assist system according to the exemplary embodiment of the present disclosure.
Figure 3:
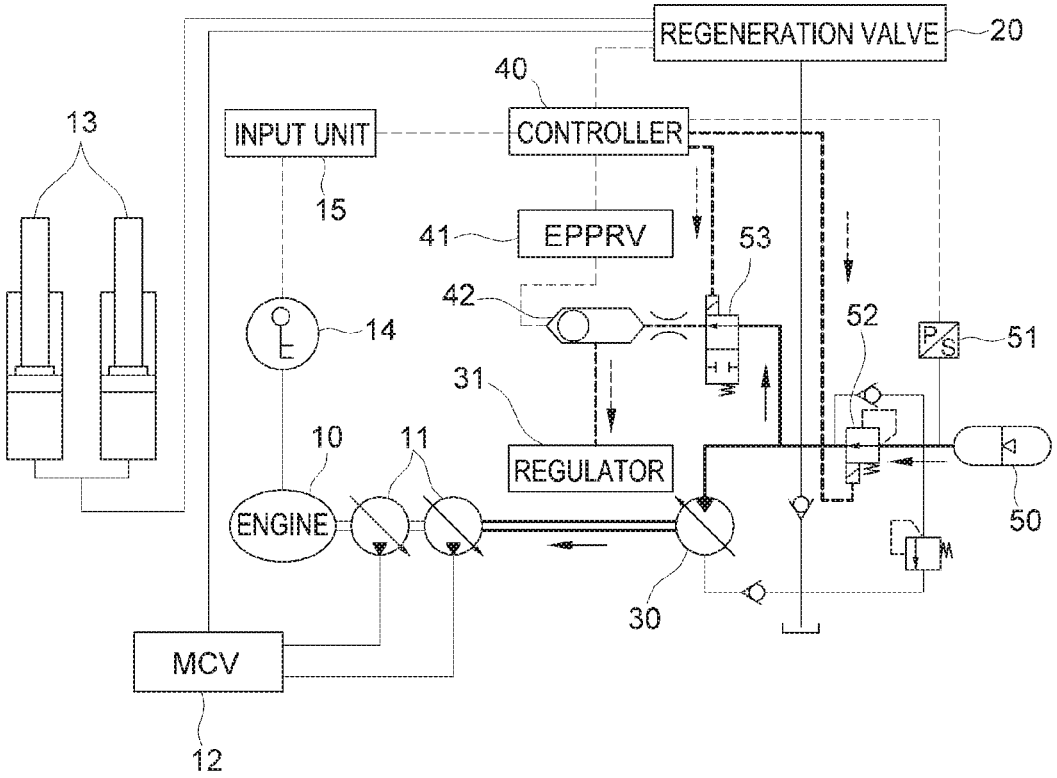

As illustrated in FIGS. 1 to 3, the construction machine starting assist system according to the exemplary embodiment of the present disclosure includes an engine 10, an input unit 15, hydraulic pumps 30, an actuator 13, a regeneration valve 20, an accumulator 50, a charging valve 52, and a hydraulic motor 11.

In addition, the construction machine starting assist system according to the exemplary embodiment of the present disclosure may further include a solenoid valve 53 and a controller 40.

The engine 10 serves to allow the construction machine to perform working and traveling operations. Typically, a diesel engine is mounted in the construction machine.

The input unit 15 receives a key-on signal and a key-off signal by a key switch 14 connected to the engine 10.

The hydraulic pumps 11 are operated by the engine 10. The hydraulic pumps 11 receive power from the engine 10 and convert the power into pressure energy.

In this case, in the exemplary embodiment of the present disclosure, the two hydraulic pumps 11I are illustrated as being used like a general excavator, but one or three or more hydraulic pumps 11 may be used.

The actuator 13 is an actuator for operating a boom of the construction machine, and the actuator 13 is reciprocally operated by hydraulic oil supplied or discharged from a head side and a rod side of the actuator.

The regeneration valve 20 is switched to supply the hydraulic oil. Specifically, the regeneration valve 20 is switched so that a part or an entirety of the hydraulic oil returned from the actuator 13 and a part or an entirety of the hydraulic oil discharged from the hydraulic pump 30 are supplied for regeneration.

The accumulator 50 is temporarily charged with energy.

The accumulator 50 according to the exemplary embodiment of the present disclosure is charged with the hydraulic oil discharged by the reciprocal movement of the actuator 13 and the hydraulic oil discharged from the hydraulic pump 11.

In this case, a pressure sensor 51 may be provided at one side of the accumulator 50.

The pressure sensor 51 detects the amount of hydraulic oil with which the accumulator 50 is charged. The controller 40 determines whether the amount of hydraulic oil detected by the pressure sensor 51 may be utilized to produce assistive starting torque for assisting in starting the engine 10.

If the amount of hydraulic oil with which the accumulator 50 is charged cannot assist in starting the engine 10, the controller 40 operates the hydraulic pump 11 to supply a larger amount of hydraulic oil to the accumulator 50.

The accumulator 50 is charged with the hydraulic oil discharged from the actuator 13 and the hydraulic oil discharged from the hydraulic pump 11 only when starting the engine 10 of the construction machine.

The hydraulic motor 30 is operated by the hydraulic oil supplied through the regeneration valve 20 or the accumulator 50. The hydraulic motor 30 converts pressure energy generated by the hydraulic pump 11 into rotational energy. A swash plate angle of the hydraulic motor 30 is adjusted by a regulator 31. The hydraulic motor 30 supplements driving power of the engine 10.

The charging valve 52 discharges the hydraulic oil with which the accumulator 50 is charged.

Specifically, when the key-on signal is inputted into the engine 10 by the key switch 14, the charging valve 52 decreases a preset relief pressure by a predetermined value, thereby discharging the hydraulic oil with which the accumulator 50 is charged. A value of the relief pressure of the charging valve 52 according to the exemplary embodiment of the present disclosure is, but not limited to, about 100 bar.

That is, the charging valve 52 according to the exemplary embodiment of the present disclosure is configured as a variable relief valve in order to change a preset value of the relief pressure.

The solenoid valve 53 controls the swash plate angle of the hydraulic motor 30.

Specifically, the solenoid valve 53 receives the hydraulic oil discharged from the accumulator 50 and adjusts the swash plate angle of the hydraulic motor 30. In this case, the swash plate angle of the hydraulic motor 30 is adjusted in accordance with the amount of hydraulic oil supplied from the accumulator 50 to the solenoid valve 53.

The controller 40 controls the regeneration valve 20 and the solenoid valve 53. The charging valve 52 and the solenoid valve 53 are switched by an electrical signal outputted from the controller 40.

An operation of the controller 40 will be specifically described with reference to FIGS. 1 to 3.

While the engine 10 is started, the hydraulic pump 11 is operated by the operation of the engine 10, and the hydraulic oil is discharged.

The hydraulic oil discharged from the hydraulic pump 11 is supplied to the regeneration valve 20 via a main control valve (MCV) 12. In addition, the hydraulic oil discharged from the actuator 13 is also supplied to the regeneration valve 20.

The regeneration valve 20 provides the supplied hydraulic oil to the accumulator 50, and the accumulator 50 is charged with the provided hydraulic oil.

Even after the engine 10 is turned off, the hydraulic oil with which the accumulator 50 is charged remains.

In a case in which the engine 10 is started again, the relief pressure of the charging valve 52 is decreased by a predetermined value, such that the hydraulic oil with which the accumulator 50 is charged is delivered to the solenoid valve 53.

In this case, the regeneration valve 20 and the solenoid valve 53 are switched by a signal of the controller 40.

The controller 40 also transmits a signal to an electromagnetic proportional pressure reducing valve (EPPRV) 41 and a shuttle valve 42 in addition to the regeneration valve 20 and the solenoid valve 53.

The hydraulic oil delivered to the solenoid valve 53 is supplied to the shuttle valve 42, and the shuttle valve 42 supplies the high-pressure hydraulic oil, which is delivered from the solenoid valve 53, to a regulator 31, which controls the swash plate angle of the hydraulic motor 30.

Then, the regulator 31 increases the swash plate angle of the hydraulic motor 30 in accordance with the amount of supplied hydraulic oil so as to allow the hydraulic oil with which the accumulator 50 is charged to flow toward the hydraulic pump 11, thereby reducing a load when starting the engine 10.

With the aforementioned configurations, the construction machine starting assist circuit according to the exemplary embodiment of the present disclosure stores the hydraulic oil in the accumulator 50 while the engine 10 is started, and uses the hydraulic oil to produce assistive starting torque for reducing a load of the engine 10 when the engine 10 is started again, thereby effectively improving cold startability of the construction machine.

Figure 4:
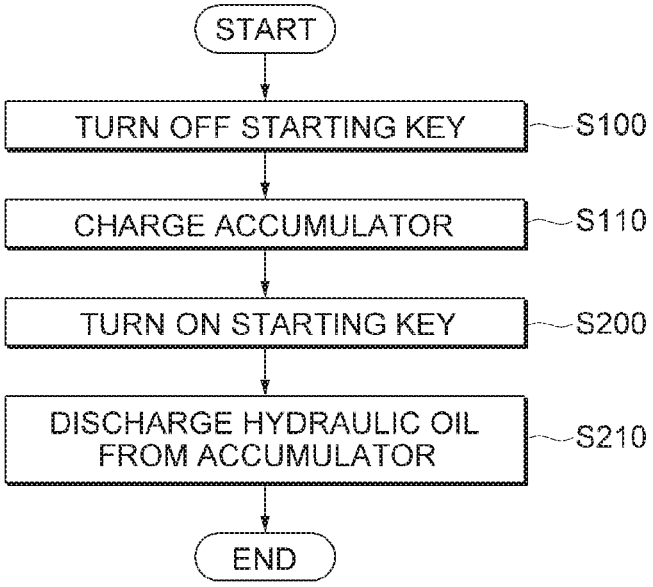
FIGS. 4 to 6 are flowcharts illustrating operational sequences of the construction machine starting assist system illustrated in FIG. 1.
Figure 5:
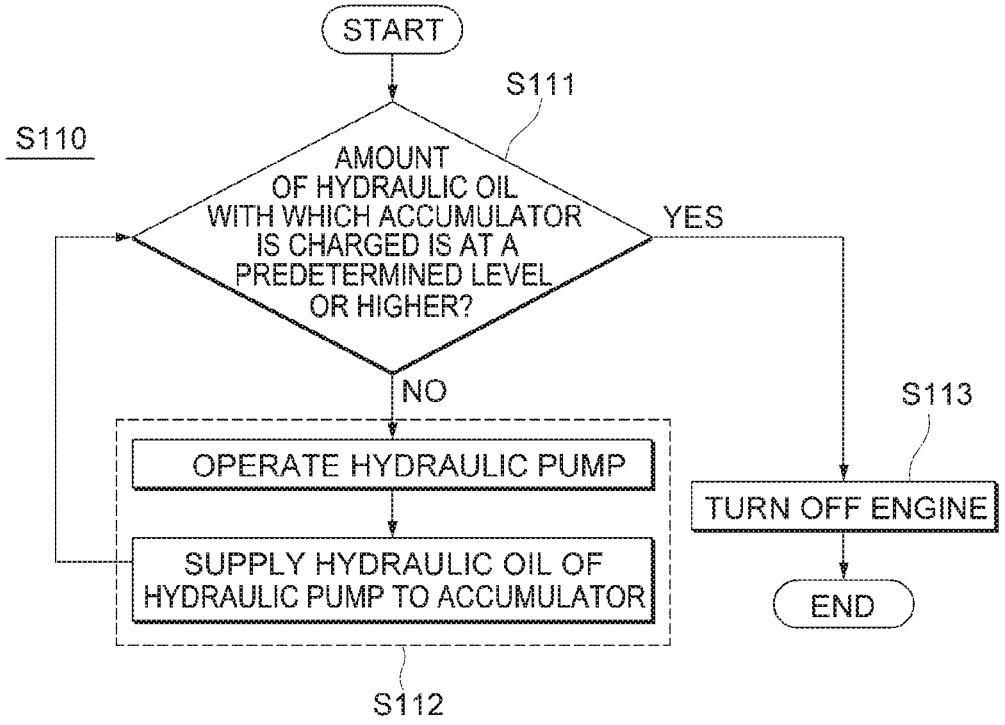
Figure 6:
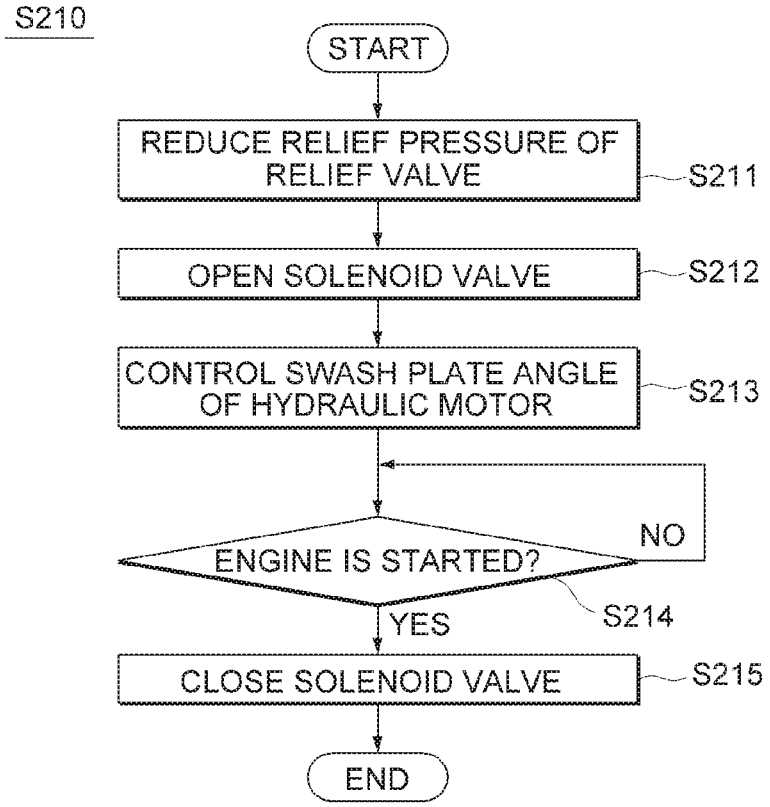

A method of controlling the construction machine starting assist system according to the exemplary embodiment of the present disclosure will be described with reference to FIGS. 4 to 6.

First, the input unit 15 receives a starting key-off signal (SI 00).

When it is determined that a starting key is turned off, the accumulator 50 is charged with the hydraulic oil (S110).

As described above, the accumulator 50 is charged with the hydraulic oil while the engine 10 of the construction machine is operated. In other words, even though the engine 10 of the construction machine is turned off, the accumulator 50 is charged with the hydraulic oil for assisting in starting the engine 10 of the construction machine.

The amount of hydraulic oil with which the accumulator 50 is charged is detected by using the pressure sensor 51 (S111).

If the detected amount of hydraulic oil is below a value of the assistive starting torque that may assist in starting the engine 10, the hydraulic pump 11 connected to the engine 10 of the construction machine is operated to supplement the insufficient hydraulic oil in order to charge the accumulator 50 with the hydraulic oil (S112).

On the contrary, if the detected amount of hydraulic oil is equal to or larger than the predetermined value of the assistive starting torque, the engine 10 of the construction machine is turned off in order to prevent the accumulator 50 from being further charged with the hydraulic oil (S113).

In a case in which the accumulator 50 is charged with the amount of hydraulic oil which is equal to or larger than the predetermined value, the starting key of the construction machine is turned on (S200). In this case, the operation of turning on the starting key means that the engine 10 of the construction machine may be started.

In this case, when the starting key is turned on, the hydraulic oil with which the accumulator 50 is charged is discharged to start the engine 10 (S210).

The relief pressure is decreased by the charging valve 52 in order to discharge the hydraulic oil with which the accumulator 50 is charged (S211). Then, the solenoid valve 53 is opened by the hydraulic oil discharged from the accumulator 50 (S212).

When the solenoid valve 53 is opened, the charging hydraulic oil is supplied to the regulator 31, and the regulator 31 controls the swash plate angle in accordance with the amount of supplied hydraulic oil, thereby controlling the hydraulic motor 30 (S213).

When the swash plate angle is increased, the hydraulic oil flows through the hydraulic motor 30, thereby allowing the assistive starting torque for starting the engine 10 to be generated in the hydraulic motor 30.

In this case, whether the engine 10 is operated is determined (S214).

If the engine 10 is in a non-operated state, a standby state is maintained to operate the engine 10. That is, the standby state means a state in which the engine 10 may be operated at any time as necessary.

On the contrary, when the engine 10 is operated, the solenoid valve 53 is closed by the controller 40 (S215).

The aforementioned method of controlling the construction machine starting assist system uses the accumulator 50 and the hydraulic motor 30 as a starter motor for starting the engine 10, and as a result, the accumulator 50 and the hydraulic motor 30 may assist in starting the engine 10 or may autonomously start the engine 10.

While the exemplary embodiments of the present disclosure have been described with reference to the accompanying drawings, those skilled in the art will understand that the present disclosure may be carried out in any other specific form without changing the technical spirit or an essential feature thereof.

Accordingly, it should be understood that the aforementioned exemplary embodiments are illustrative in all aspects and are not restrictive, and the scope of the present disclosure shall be represented by the claims to be described below, and it should be construed that all of the changes or modified forms induced from the meaning and the scope of the claims, and an equivalent concept thereto are included in the scope of the present disclosure.

The invention claimed is:

1. A construction machine starting assist system comprising:

an engine of a construction machine;

an input unit configured to receive a key-on signal and a key-off signal of the engine;

a hydraulic pump which is operated by the engine;

an actuator which is operated by hydraulic oil discharged from the hydraulic pump;

a regeneration valve which is switched so that a part or an entirety of the hydraulic oil returned from the actuator and a part or an entirety of the hydraulic oil discharged from the hydraulic pump are supplied for regeneration;

an accumulator configured to be charged with the hydraulic oil supplied from the regeneration valve;

a charging valve configured to discharge the hydraulic oil from the accumulator when the key-on signal is inputted into the input unit;

a hydraulic motor which is operated by the hydraulic oil discharged from the charging valve, and is connected to the engine and configured to assist in starting the engine;

a solenoid valve configured to receive the hydraulic oil from the accumulator and configured to adjust a swash plate angle of the hydraulic motor;

a controller configured to control the regeneration valve and the solenoid valve; and a pressure sensor configured to detect a hydraulic pressure of the hydraulic oil with which the accumulator is charged, wherein the controller determines the hydraulic pressure of the hydraulic oil with which the accumulator is charged by the pressure sensor; and wherein the input unit receives the key-off signal when the hydraulic pressure of the accumulator is below a predetermined value, causing the controller to operate the engine to charge the accumulator with the hydraulic oil discharged from the hydraulic pump until the hydraulic pressure of the hydraulic oil with which the accumulator is charged reaches the predetermined value, and wherein when the hydraulic pressure of the accumulator is equal to or greater than the predetermined value, the controller turns off the engine after receiving the key-off signal, wherein the solenoid valve adjusts the swash plate angle of the hydraulic motor in accordance with the amount of the hydraulic oil supplied from the accumulator through a regulator, and a shuttle valve supplies the hydraulic oil from the solenoid valve to the regulator, wherein when the engine is turned off, the controller closes the solenoid valve to cut off the flow of the hydraulic oil to the regulator.

2. The construction machine starting assist system of claim 1, wherein the hydraulic oil charged in the accumulator remains in the accumulator after the engine is turned off.

3. The construction machine starting assist system of claim 1, wherein the hydraulic motor assists in starting the engine by generating assistive starting torque using the hydraulic oil supplied from the accumulator.

4. A method comprising:

receiving, by an input unit, a first key-on signal at a first time;

in response to receiving the key-on signal, starting an engine of a construction machine, wherein the engine is configured to operate a hydraulic pump;

receiving, by a regeneration valve, hydraulic oil, from the hydraulic pump;

charging, by the regeneration valve, an accumulator with the hydraulic oil while the engine is operating;

receiving, by the input unit, a key-off signal at a second time after the first time;

in response to receiving the key-off signal, determining whether the amount of the hydraulic oil charged in the accumulator is equal to or greater than a predetermined value;

determining that the amount of the hydraulic oil charged in the accumulator is not equal to or greater than the predetermined value;

operating the engine to charge the accumulator with the hydraulic oil discharged from the hydraulic pump until the amount of the hydraulic oil in the accumulator reaches the predetermined value, and in response to the determination, turning off the engine, wherein the hydraulic oil charged in the accumulator remains in the accumulator after the engine is turned off, receiving, by the input unit, a second key-on signal at a third time after the second time;

supplying the hydraulic oil from the accumulator to a solenoid valve to open the solenoid valve, wherein a shuttle valve supplies the hydraulic oil from the solenoid valve to a regulator;

receiving, by the regulator, the hydraulic oil from the accumulator when the solenoid valve is opened;

adjusting, by the regulator, a swash plate angle of a hydraulic motor connected to the engine in accordance with the amount of the hydraulic oil supplied from the accumulator;

determining whether the engine is restarted; and in response to determining the engine is not restarted, maintaining the engine in a standby state to start the engine at a later time.

5. The method of claim 4, wherein the regeneration valve is further configured to receive the hydraulic oil from an actuator.

6. The method of claim 4, wherein the hydraulic oil charged in the accumulator is supplied to the hydraulic motor to generate assistive starting torque for assisting in starting the engine when the swash plate angle of the hydraulic motor is adjusted.

7. The method of claim 6, further comprising restarting the engine at a fourth time after the third time using the assistive starting torque generated by the hydraulic motor.

8. The method of claim 7, further comprising:

determining that the engine is restarted;

in response to the determination that the engine is restarted, closing the solenoid valve to cut off the hydraulic oil from the accumulator to the hydraulic motor.

* * * * *